US008603326B2

(12) United States Patent
Painter et al.

(10) Patent No.: US 8,603,326 B2
(45) Date of Patent: Dec. 10, 2013

(54) SYSTEMS, METHODS AND COMPOSITIONS FOR THE SEPARATION AND RECOVERY OF HYDROCARBONS FROM PARTICULATE MATTER

(75) Inventors: Paul Painter, Boalsburg, PA (US); Phil Williams, State College, PA (US); Ehren Mannebach, Fond du Lac, WI (US); Aron Lupinsky, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 142 days.

(21) Appl. No.: 12/854,553

(22) Filed: Aug. 11, 2010

(65) Prior Publication Data

US 2011/0042318 A1 Feb. 24, 2011

Related U.S. Application Data

(60) Provisional application No. 61/236,405, filed on Aug. 24, 2009.

(51) Int. Cl.
*C10G 1/04* (2006.01)

(52) U.S. Cl.
USPC ..... 208/390; 208/391; 208/424; 208/425; 208/428

(58) Field of Classification Search
USPC ..... 208/390, 391, 424, 425, 428; 210/664, 210/660, 663
See application file for complete search history.

(56) References Cited

U.S. PATENT DOCUMENTS

| | | | | |
|---|---|---|---|---|
| 3,330,757 | A | 7/1967 | Bichard | |
| 3,487,003 | A | 12/1969 | Baillie et al. | |
| 3,723,310 | A | 3/1973 | Lang et al. | |
| 4,172,025 | A * | 10/1979 | Porteous et al. | 208/391 |
| 4,929,341 | A | 5/1990 | Thirumalachar | |
| 2007/0111903 | A1 * | 5/2007 | Engel et al. | 507/261 |
| 2009/0054226 | A1 | 2/2009 | Mironov et al. | |
| 2011/0108466 | A1 | 5/2011 | Petcavich | |

FOREIGN PATENT DOCUMENTS

| | | |
|---|---|---|
| CA | 1152920 | 8/1983 |
| WO | 03/086605 | 10/2003 |
| WO | 2005/028592 | 3/2005 |

OTHER PUBLICATIONS

Allen, E. W. "Process water treatment in Canada's oil sands industry: I. Target pollutants and treatment objectives", J. Environ. Eng. Sci., vol. 7, pp. 123-138, (2008).
Allen, E. W., "Process water treatment in Canada's oil sands industry: II. A review of emerging technologies", J. Environ. Eng. Sci., vol. 7, pp. 499-524, (2008).
Amyes, T. L., et al., "Formation and stability of N-heterocyclic carbenes in water: The carbon acid pKa of imidazolium cations in aqueous solution", J. Am. Chem. Soc., vol. 126, pp. 4366-4374, (2004).
Blasucci, et al., "Single Component, Reversible Ionic Liquids for Energy Applications", Fuel, vol. 89, pp. 1315-1319, (2010).
Budziak, C. J., et al., "Studies of fines in bitumen extracted from oil sands by heat-centrifugation", Fuel, vol. 67, pp. 1633-1638, (1988).
Dai, Q., et al., "Bitumen-Sand interaction in oil sand processing", Fuel, vol. 74, Issue 12, pp. 1858-1864, (1995).
Heinberg, R., "The Party's Over: Oil, War and the Fate of Industrial Societies", New Society Publishers, full reference and synopsis, (2005).
Houlihan, R., et al., "Recent enhancements in mined oil sands bitumen extraction technology", J Can. Petroleum Technol., vol. 26, pp. 91-96, (1987).
Koel, et al., "Ionic Liquids for Oil Shale Treatment", "Green Industrial Applications of Ionic Liquids", Edited by R. D. Rogers, et al., NATO Science Series II: Mathematics, Physics and Chemistry, Kluwe Academic Publishers, pp. 193-208, (2002).
Koel, "Use of Ionic Liquids in Oil Shale Processing, Ionic Liquids IIIB: Fundamentals, Progress, Challenges and Opportunities", Edited by R. D. Rogers, et al., ACS Symposium Series, pp. 72- 82, (2005).
Liu, J., et al., "Studies on bitumen-silica interaction in aqueous solutions by atomic force microscopy", Mendeley, Langmuir, vol. 19, pp. 3911-3920, (2003).
Masliyah, J., et al., "Understanding Water-Based Bitumen Extraction from Athabasca Oil Sands", Canadian J. Chem. Eng., vol. 82, Issue 4, pp. 628-654, (Aug. 2004).
Patell, et al., "The Dissolution of Kerogens in Ionic Liquids", "Green Industrial Applications of Ionic Liquids", Edited by R. D. Rogers, et al., Nato Science Series, Kluwe Academic Publishers, pp. 499-510, (2002).
Plechkova, N. V., et al., "Applications of ionic liquids in the chemical industry", Chem. Soc. Rev., vol. 37, pp. 123-150, (2008).
Toma, S., et al., "Are Ionic Liquids Suitable Media for Organocatalytic Reactions?", European Journal of Organic Chemistry, vol. 3, pp. 321-327, (2009).
Weingartner, W., "Understanding ionic liquids at the molecular level: Facts, problems and controversies", Angew. Chem. Int. Ed., vol. 47, pp. 654-670, (2008).
International Search Report PCT/US2010/45155, International Filing Date: Aug. 11, 2010.
Written Opinion of the International Searching Authority for PCT/US2010/45155.
Supplementary European Search Report (EPO) for mailed on Feb. 1, 2013 in International Application No. EP1 0 81 2485. (7 pages).

(Continued)

*Primary Examiner* — Prem C Singh
*Assistant Examiner* — Michelle Stein
(74) *Attorney, Agent, or Firm* — McDermott Will & Emery LLP

(57) ABSTRACT

Systems, methods and compositions for the separation and recovery of hydrocarbons from particulate matter are herein disclosed. According to one embodiment, a method includes contacting particulate matter with at least one ionic liquid. The particulate matter contains at least one hydrocarbon and at least one solid particulate. When the particulate matter is contacted with the ionic liquid, the hydrocarbon dissociates from the solid particulate to form a multiphase system.

16 Claims, 11 Drawing Sheets

(56) References Cited

OTHER PUBLICATIONS

Painter et al., "Recovery of Bitumen from oil or tar sands using ionic liquids", Energy & Fuels (2009), Sep. 22, 2009, 24(2): 1094-1098.

Painter et al. "Recovery of bitumen from Utah tar sands using ionic liquids", Energy & Fuels (2010), Aug. 12, 2010, 24:5081-5088.

Williams et al., "Recovery of Bitumen from low-grade oil sands using ionic liquids", Energy & Fuels (2010), Feb. 3, 2010, 24(3): 2172-2173.

Hogshead et al. "Studies of bitumen—silica and oil—silica interactions in ionic liquids", Energy & Fuels (2011), Nov. 17, 2010, 25:293-299.

* cited by examiner

SYSTEMS, METHODS AND COMPOSITIONS FOR THE SEPARATION AND RECOVERY OF HYDROCARBONS FROM PARTICULATE MATTER

CROSS REFERENCE TO RELATED APPLICATIONS

This application claims priority from U.S. provisional application No. 61/236,405, entitled "METHOD FOR RECOVERING BITUMEN FROM OIL SANDS," filed on Aug. 24, 2009, which is incorporated by reference in its entirety, for all purposes, herein.

STATEMENT AS TO FEDERALLY SPONSORED RESEARCH

This invention was made with government support under Grant Nos. DMR0901180 and DMR0851897, awarded by the National Science Foundation. The Government has certain rights in the Invention.

FIELD OF TECHNOLOGY

The present application is directed to systems, methods and compositions for the separation and recovery of hydrocarbons from particulate matter.

BACKGROUND

Oil sands, also referred to as tar sands, contain a significant quantity of the world's known oil reserves. Large deposits of oil sands are found in Canada, Venezuela and in the United States in eastern Utah. Oil sands are a complex mixture of sands, clays, water and viscous hydrocarbon compounds, known as bitumen. Typically, the extraction and separation of bitumen from oil sands involves the use of significant amounts of energy and heated water. Approximately 19 barrels of water are required for every barrel of oil produced. Water, sodium hydroxide (NaOH) and other additives are mixed with the oil sands to form a slurry. The NaOH releases surfactants from the oil sands and improves bitumen recovery. The slurry is conditioned by mixing and/or shearing the slurry to detach bitumen from the oil sands particles. Bitumen is separated from water by aeration to form an oil containing froth that can be skimmed off the surface of the water. The remaining process water is a complex mixture of alkaline water, dissolved salts, minerals, residual bitumen, surfactants released from the bitumen and other materials used in processing. Additional processing of the water is required to remove residual bitumen The process water is ultimately stored in tailing ponds and is acutely toxic to aquatic life. The process water recycled from tailings ponds causes scaling and corrosion problems that often adversely affect the optimum recovery of bitumen. In addition, very fine mineral particles such as clays are co-extracted with the bitumen and must be removed in subsequent processing steps that ultimately reduce the yield of bitumen. Although a large proportion of the water used in the process (about 16 barrels) is now recycled from tailing ponds, the production of each barrel of oil still requires importing an additional 3 barrels of fresh water. The necessity of large quantities of water has prevented the recovery of bitumen deposits from oils sands in arid areas such as Utah.

Several other related scenarios require the removal of oil from sand or solid particles in oil and gas operations. During drilling operations, drilling fluids used to cool and clean the drill bit become contaminated with formation cuttings. Formation cuttings must be removed from the drilling fluid before reuse of drilling fluid. During production operations, crude oil produced from unconsolidated formations can also contain sand including mixtures of various minerals and silt that require removal prior to processing the oil. The oil coated sand must also be cleaned before disposal or re-depositing.

An increase in offshore drilling operations has also increased the risk of coastal communities and beaches being exposed to crude oil produced from offshore oil rigs. As described above, current methods for the removal of oil from sand require large quantities of water and energy. Physical methods for removing oil from beach sand including the use of shovels, cleaning forks and lift and screen systems require large amounts of labor and do not efficiently remove all the decontaminate from the sand.

In view of the foregoing, there is a need in the field of art for improved systems, methods and compositions for the separation and recovery of hydrocarbons from particulate matter.

SUMMARY

Systems, methods and compositions for the separation and recovery of hydrocarbons from particulate matter are herein disclosed. According to one embodiment, a method includes contacting particulate matter with at least one ionic liquid. The particulate matter contains at least one hydrocarbon and at least one solid particulate. When the particulate matter is contacted with the ionic liquid, the hydrocarbon dissociates from the solid particulate to form a multiphase system.

The foregoing and other objects, features and advantages of the present disclosure will become more readily apparent from the following detailed description of exemplary embodiments as disclosed herein.

BRIEF DESCRIPTION OF THE DRAWINGS

Embodiments of the present application are described, by way of example only, with reference to the attached Figures, wherein.

DETAILED DESCRIPTION

Figure 1:
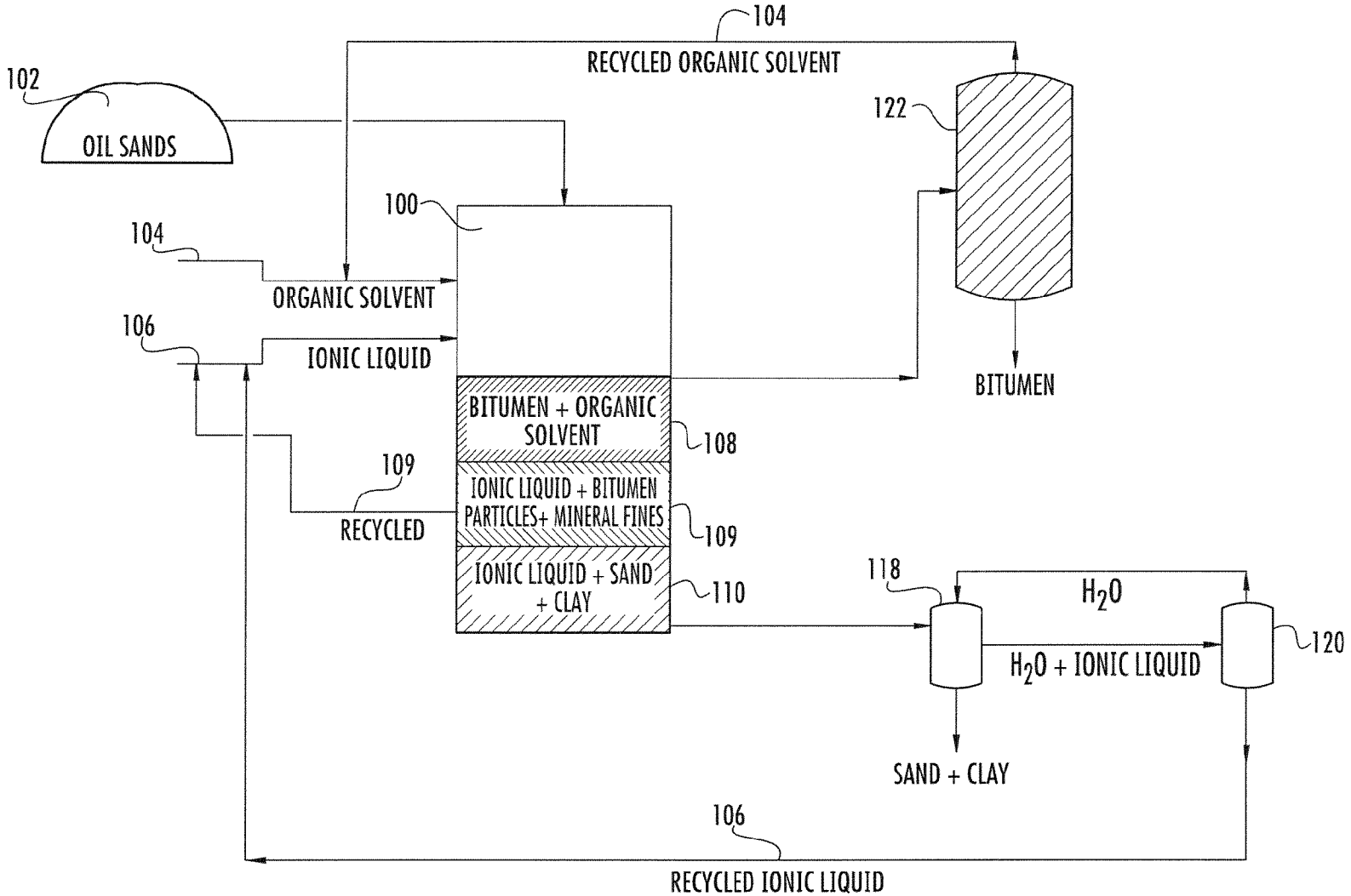
FIG. 1 illustrates an exemplary system for recovering bitumen from oil sands according to one embodiment.

It will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, methods, procedures and components have not been described in detail so as not to obscure the embodiments described herein.

Systems, methods and compositions for the separation and recovery of hydrocarbons from particulate matter are herein disclosed. One or more ionic liquids herein disclosed can be mixed with or otherwise placed in contact with particulate matter comprising at least one hydrocarbon and at least one solid particulate. When contacted with an ionic liquid, the hydrocarbon separates or dissociates from the solid particulate. The particulate matter can include, but is not limited to the following: oil sands, drilling fluid containing drill cuttings, crude oil containing sand, beach sand contaminated with oil, oil sludge, any hydrocarbon containing sand, soil, rock, silt, clay or other solid particulate or any hydrocarbon contained within sand, soil, rock, silt, clay or other solid particulate.

The ionic liquids disclosed herein are thermally stable, chemically stable, have negligible vapor pressure, and are soluble in water and insoluble in non-polar organic solvents, such as non-polar hydrocarbon solvents. The ionic liquids substantially degrade into a corresponding amino acid at room temperature when reacted with hydrogen peroxide and ions, such as iron ions. Therefore, the ionic liquids can be contained or reacted into innocuous amino acids if they are inadvertently or deliberately released into the environment. The ionic liquids can include at least one compound formed from imidazolium cations and at least one anion. The ionic liquids can include at least one compound including, but not limited to: 1-butyl-2,3-dimethyl-imidazolium; borontetrafluoride; 1-butyl-2,3-dimethyl-imidazolium; trifluoromethanesulfonate; 1-butyl-3-methyl-imidazolium; trifluoromethanesulfonate; 1-butyl-3-methyl-imidazolium chloride; 1-ethyl-3-methyl-imidazolium chloride; tetraalkyl ammonia salts; pyrrolidinium based salts or any other ionic liquid that is soluble in water and insoluble in non-polar organic solvents.

The ionic liquids disclosed herein are used to separate particulate matter at relatively low temperatures of below 100° C., preferably below 50° C. and more preferably 25° C. and lower. Optionally, the separation temperature can be raised to lower the viscosity of the hydrocarbon being separated and aid in separation from particulate material. The separation temperature can be raised by any heating means including electric heating means, electromagnetic heating means, microwave heating means or other heating means.

An organic solvent and/or water can also be added to or mixed with the ionic liquid and the particulate matter to obtain optimal separation of hydrocarbon from the solid particulate. The organic solvent lowers the viscosity of the hydrocarbon and aids in the separation from the solid particulate. The organic solvents herein disclosed dissolve non-polar hydrocarbons such as bitumen, oil or drilling fluid and are immiscible with the ionic liquids disclosed above. The organic solvent can include, but is not limited to at least one of the following compounds: toluene, naphtha, hexane, kerosene, paraffinic solvents or any other non-polar hydrocarbon solvent that dissolves the hydrocarbon and is immiscible with the ionic liquid.

FIG. 1 illustrates an exemplary system for recovering bitumen from oil sands 102 according to one embodiment. Oil sands 102 can include sand, clay, other minerals, and bitumen. The oil sands 102 are mixed with an organic solvent 104 and an ionic liquid 106 in a primary mixing vessel 100. The primary mixing vessel 100 can be any vessel known in the art for mixing or containing liquids, solids or slurries. When mixed with the organic solvent 104 and the ionic liquid 106, the bitumen is separated from the oil sands 102 and a three-phase system including a top phase, middle phase and bottom phase is formed.

The bottom phase 110 consists of ionic liquid 106 with suspended sand and clay. The middle phase 109 consists of ionic liquid 106 with small amounts of dissolved or suspended bitumen particles and mineral fines. The top phase 108 consists of organic solvent 104 and bitumen. The bottom phase 110, the middle phase 109 and the top phase 108 can be drained from the primary mixing vessel 100 for further processing and/or recycling though the system.

The bitumen in the top phase 108 can be recovered after separating or evaporating the organic solvent 104 from the bitumen in a primary separator 122. The primary separator 122 can be a decanter, distillation column, pressure separator, centrifuge, open tank, hydroclone, settling chamber or other separator known in the art for separating mixtures. The organic solvent 104 can be condensed, recycled to the primary mixing vessel 100 and mixed with additional oil sands 102, organic solvent 104 and ionic liquid 106 to achieve three-phase separation.

The middle phase 109 and substantially all of the ionic liquid 106 introduced into the system can be retained in the mixing vessel 100. In this way, the ionic liquid 106 in the middle phase 109 is not moved throughout the system. If removed for additional processing, the middle phase 109 can be recycled to the primary mixing vessel 100 and mixed with additional oil sands 102, organic solvent 104 and ionic liquid 106 to achieve three-phase separation. The concentration of bitumen within the middle phase 109 is expected to reach equilibrium and therefore will not accumulate. If necessary, organic solvent 104 can be added to the middle phase 109 in an additional processing step to separate any entrained or suspended bitumen from the ionic liquid 106 before the ionic liquid 106 is recycled to the primary mixing vessel 100.

The bottom phase 110 consisting of ionic liquid 106 with suspended sand and clay can be fed into a secondary mixing vessel 118 and mixed with water to form a solution of ionic liquid 106, water, and suspended sand and clay particles. The mixing vessel 118 can be any vessel known in the art for mixing or containing liquids, solids or slurries. The sand and clay can be filtered from the ionic liquid and water. The ionic liquid 106 can be recovered after separating or evaporating the water in a secondary separator 120. The separator 120 can be a decanter, distillation column, pressure separator, centrifuge, open tank or other separator known in the art for separating mixtures. After separation and/or evaporation, the water can be condensed before it is recycled to the secondary mixing vessel 118. The ionic liquid 106 can be recycled to the primary mixing vessel 100 and mixed with additional oil sands 102, organic solvent 104 and ionic liquid 106 to achieve three-phase separation.

It will be appreciated that the exemplary system for recovering bitumen from oil sands illustrated in FIG. 1 can also be used to separate other particulate matter including, but not limited to the following: oil sands, drilling fluid containing drill cuttings, crude oil containing sand, beach sand contaminated with oil, oil sludge or any hydrocarbon containing sand, soil, rock, silt, clay or other solid particulate or hydrocarbon contained within sand, soil, rock, silt, clay or other solid particulate. The ionic liquid 106 and organic solvent 104 can be mixed with or otherwise placed in contact with the particulate matter to separate or dissociate the hydrocarbon from the solid particulate and recover the hydrocarbon as described above.

Figure 2:
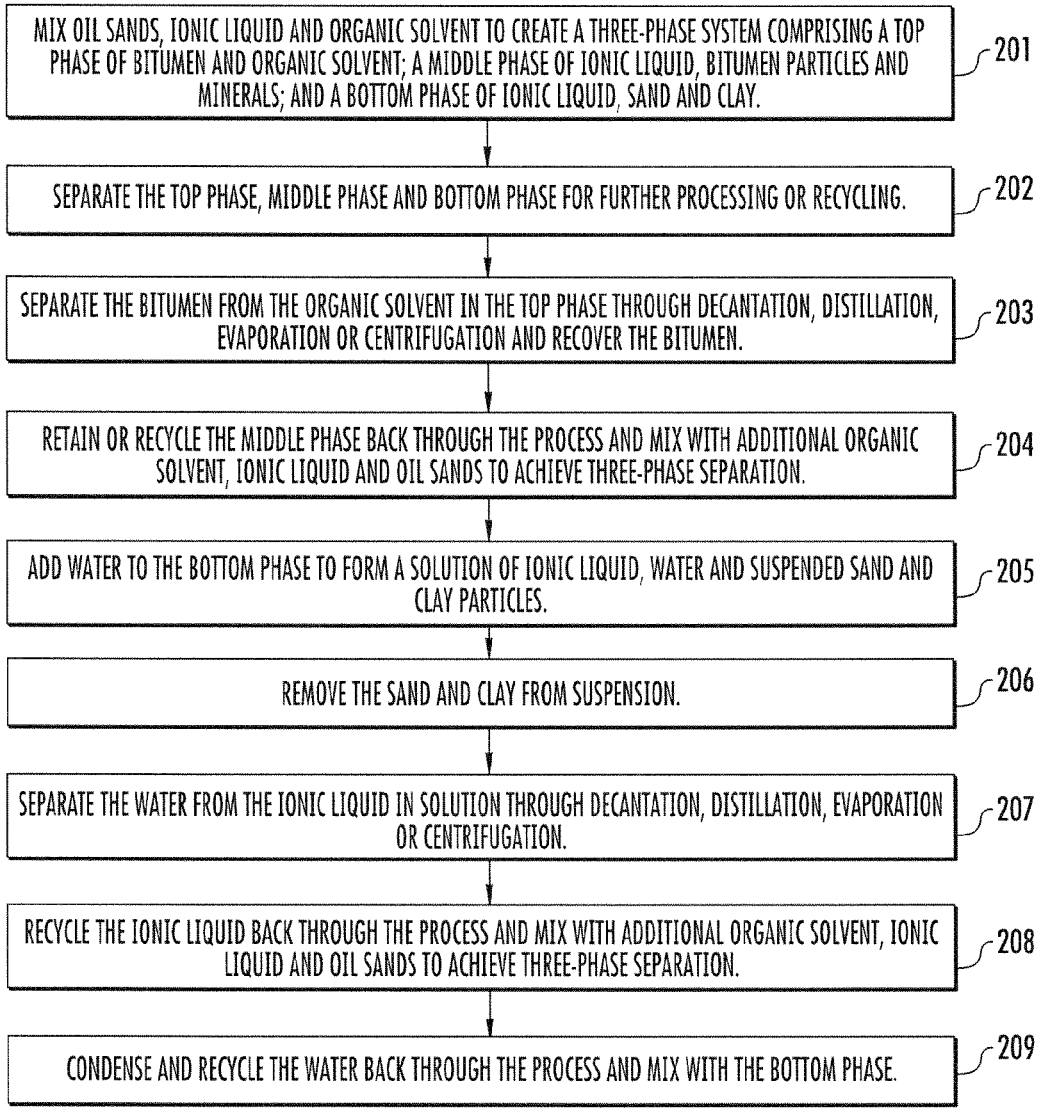
FIG. 2 illustrates a flow chart of an exemplary process for recovering bitumen from oil sands according to one embodiment.

FIG. 2 illustrates a flow chart of an exemplary process for recovering bitumen from oil sands according to one embodiment. The oil sands are mixed with an organic solvent and an ionic liquid at step 201 to form a three-phase system including a top phase, middle phase and bottom phase. The top phase consists of organic solvent and bitumen. The middle phase consists of ionic liquid with small amounts of dissolved bitumen particles and mineral fines. The bottom phase consists of ionic liquid with suspended sand and clay. The top phase, middle phase and bottom phase may be separated at step 202 for further processing or recycling back through the process.

At step 203, the bitumen and the organic solvent in the top phase are separated through decantation, distillation, evaporation or centrifugation and the bitumen is recovered. The organic solvent can be condensed, recycled and mixed with additional oil sands, organic solvent and ionic liquid to achieve three-phase separation.

At step 204, the middle phase is recycled and mixed with additional organic solvent, ionic liquid and oil sands to achieve three-phase separation. Optionally, the middle phase and/or substantially all of the ionic liquid can be retained in a primary mixing vessel within which the original oil sands, organic solvent and ionic liquid are mixed.

At step 205, water is added to the bottom phase to form a solution of water, ionic liquid and suspended sand and clay particles. The sand and clay is removed from suspension at step 206 through filtration. At step 207, the water is separated from the ionic liquid through decantation, distillation, evaporation or centrifugation and the ionic liquid is recovered. At step 208 the ionic liquid is recycled and mixed with additional organic solvent, ionic liquid and oil sands to achieve three-phase separation. The water can be condensed, recycled and mixed with the bottom phase at step 209 to separate additional ionic liquid from sand and clay.

It will be appreciated that the exemplary process for recovering bitumen from oil sands illustrated in FIG. 2 can also be used to separate other particulate matter including, but not limited to the following: oil sands, drilling fluid containing drill cuttings, crude oil containing sand, beach sand contaminated with oil, oil sludge or any hydrocarbon containing sand, soil, rock, silt, clay or other solid particulate or hydrocarbon contained within sand, soil, rock, silt, clay or other solid particulate. The ionic liquid and organic solvent can be mixed with or otherwise placed in contact with the particulate matter to separate the hydrocarbon from the solid particulate and recover the hydrocarbon as described above.

Figure 3:
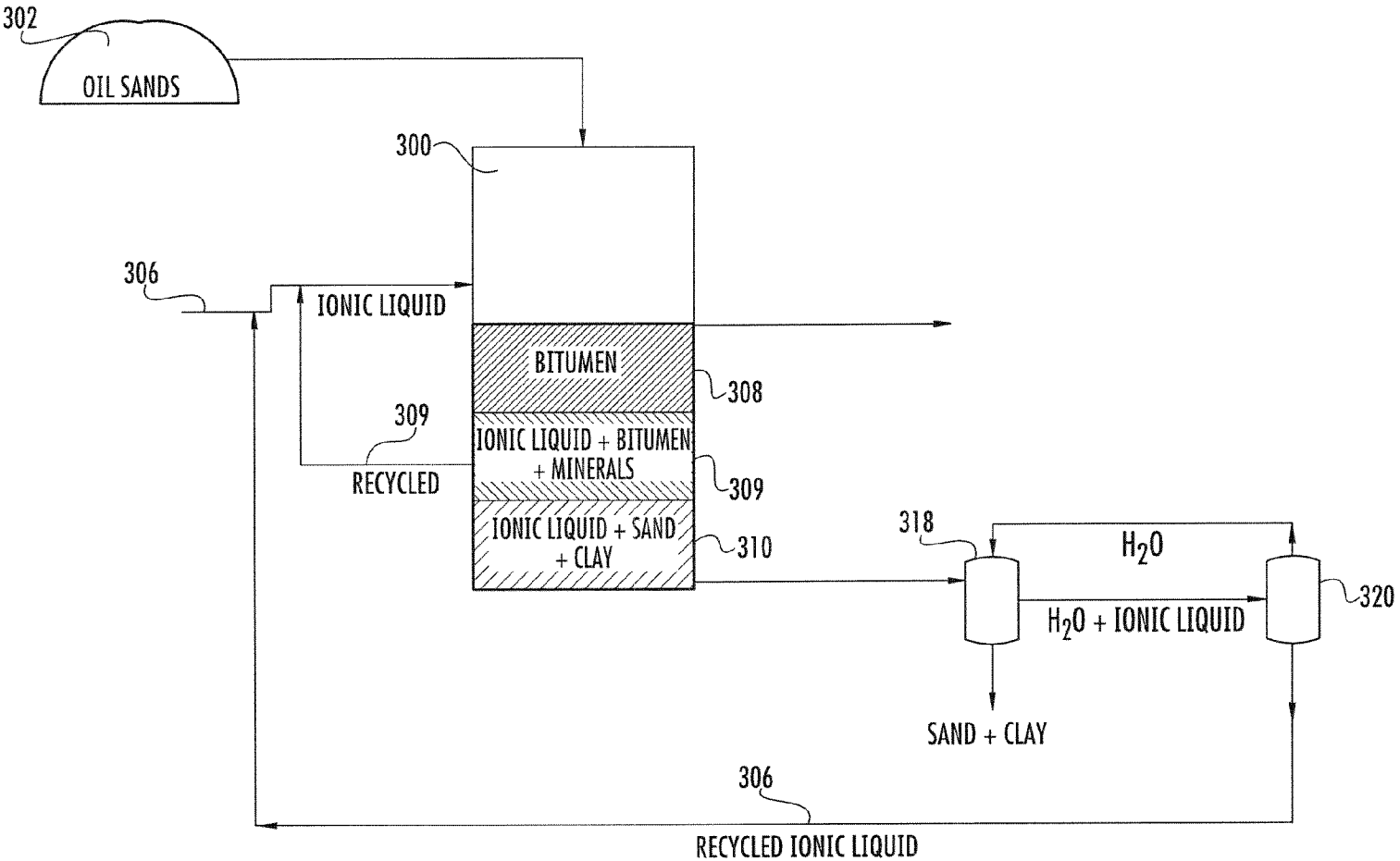
FIG. 3 illustrates an exemplary system for recovering bitumen from oil sands according to another embodiment.

FIG. 3 illustrates an exemplary system for recovering bitumen from oil sands 302 according to another embodiment. Oil sands 302 can include sand, clay, other minerals, and bitumen. The oil sands 302 are mixed with an ionic liquid 306 in a primary mixing vessel 300. The primary mixing vessel 300 can be any vessel known in the art for mixing or containing liquids, solids or slurries. When mixed with the ionic liquid 306, the bitumen is separated from the oil sands 302 and a three-phase system including a top phase, middle phase and bottom phase is formed. The bottom phase 310 consists of ionic liquid 306, sand and clay slurry. The middle phase 309 consists of ionic liquid 306, with some bitumen and minerals. The top phase 308 consists of bitumen. The bottom phase 310, the middle phase 309 and the top phase 308 can be drained from the primary mixing vessel 300 and the bitumen can be recovered.

The middle phase 309 and substantially all of the ionic liquid 306 introduced into the system can be retained in bulk in the mixing vessel 300. In this way, the ionic liquid 306 in the middle phase 309 is not moved throughout the system. If removed for additional processing, the middle phase 309 can be recycled to the primary mixing vessel 300 and mixed with additional oil sands 302 and ionic liquid 306 to achieve three-phase separation. The bitumen within the recycled middle phase 309 is expected to reach equilibrium and therefore will not accumulate.

The bottom phase 310 containing ionic liquid 106, sand and clay slurry can be fed into a secondary mixing vessel 318 and mixed with water to form a solution of ionic liquid 306, water, and suspended sand and clay particles. The mixing vessel 318 can be any vessel known in the art for mixing or containing liquids, solids or slurries. The sand and clay can be filtered from the ionic liquid and water. The ionic liquid 306 can be recovered by separating and/or evaporating the water in a secondary separator 320. The separator 320 can be a decanter, distillation column, pressure separator, centrifuge, open tank hydroclone, settling chamber or other separator known in the art for separating mixtures. After separation and/or evaporation, the water can be condensed before it is recycled to the secondary mixing vessel 318. The ionic liquid 306 can be recycled to the primary mixing vessel 300 and mixed with additional oil sands 302 and ionic liquid 306 to achieve three-phase separation.

It will be appreciated that the exemplary system for recovering bitumen from oil sands illustrated in FIG. 3 can also be used to separate other particulate matter including, but not limited to the following: oil sands, drilling fluid containing drill cuttings, crude oil containing sand, beach sand contaminated with oil, oil sludge or any hydrocarbon containing sand, soil, rock, silt, clay or other solid particulate or hydrocarbon contained within sand, soil, rock, silt, clay or other solid particulate. The ionic liquid 306 can be mixed with or otherwise placed in contact with the particulate matter to separate or dissociate the hydrocarbon from the solid particulate and recover the hydrocarbon as described above.

Figure 4:
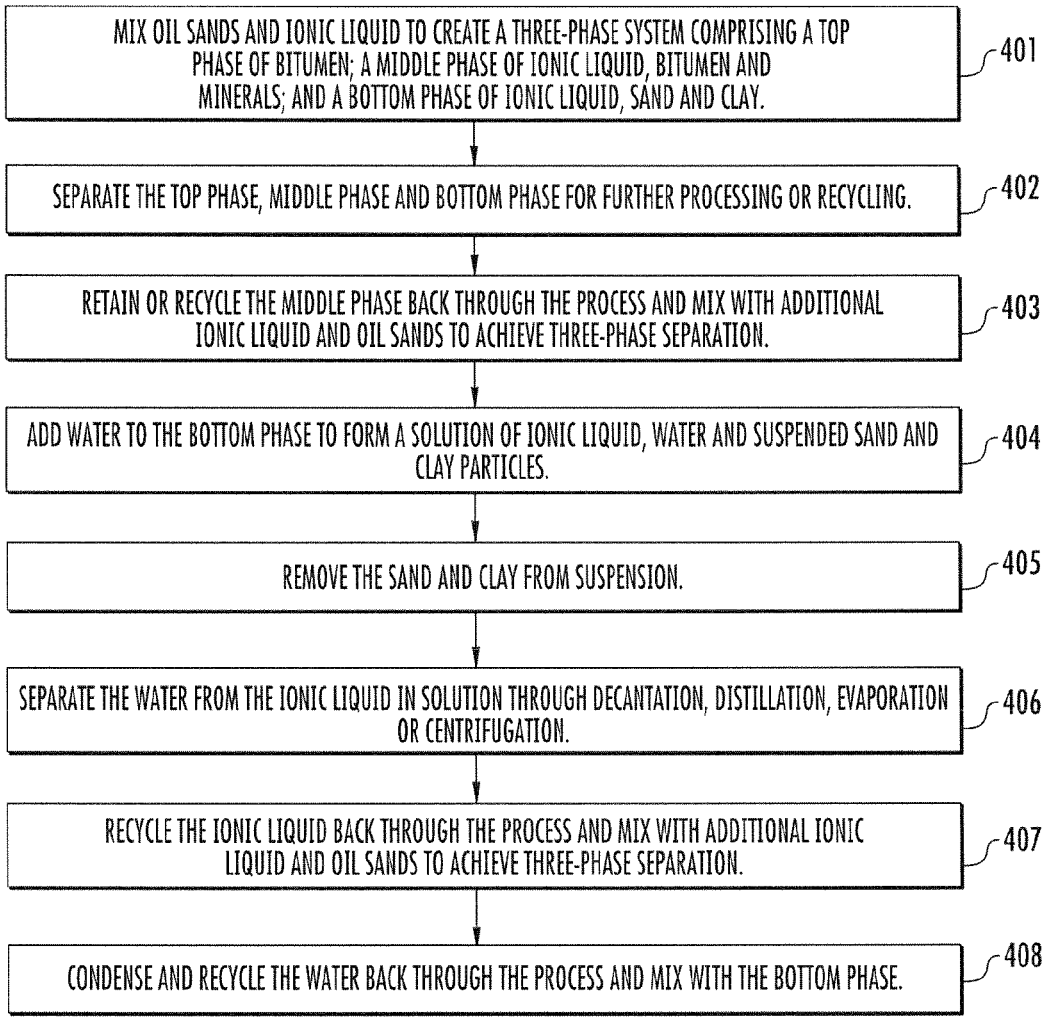
FIG. 4 illustrates a flow chart of an exemplary process for recovering bitumen from oil sands according to another embodiment.

FIG. 4 illustrates a flow chart of an exemplary process for recovering bitumen from oil sands according to another embodiment. The oil sands are mixed with an ionic liquid at step 401 to form a three-phase system including a top phase, middle phase and bottom phase. The top phase consists of bitumen. The middle phase consists of ionic liquid, with some bitumen and minerals. The bottom phase is ionic liquid, sand and clay slurry. The top phase, middle phase and bottom phase can be separated at step 402 for further processing or recycling back through the process.

At step 403, the middle phase is recycled and mixed with additional ionic liquid and oil sands to achieve three-phase separation. Optionally, the middle phase and/or substantially all of the ionic liquid can be retained in a primary mixing vessel within which the original oil sands and ionic liquid are mixed.

At step 404, water is added to the bottom phase to form a solution of water, ionic liquid and suspended sand and clay particles. The sand and clay is removed from the solution at step 405 through filtration. At step 406, the water is separated from the ionic liquid through decantation, distillation, evaporation or centrifugation and the ionic liquid is recovered. At step 407 the ionic liquid is recycled and mixed with additional ionic liquid and oil sands to achieve three-phase separation. The water can be condensed, recycled and mixed with the bottom phase at step 408 to separate additional ionic liquid from sand and clay.

It will be appreciated that the exemplary process for recovering bitumen from oil sands illustrated in FIG. 4 can also be used to separate other particulate matter including, but not limited to the following: oil sands, drilling fluid containing drill cuttings, crude oil containing sand, beach sand contaminated with oil, oil sludge or any hydrocarbon containing sand, soil, rock, silt, clay or other solid particulate or hydrocarbon contained within sand, soil, rock, silt, clay or other solid particulate. The ionic liquid can be mixed with or otherwise placed in contact with the particulate matter to separate or dissociate the hydrocarbon from the solid particulate and recover the hydrocarbon as described above.

Figure 5:
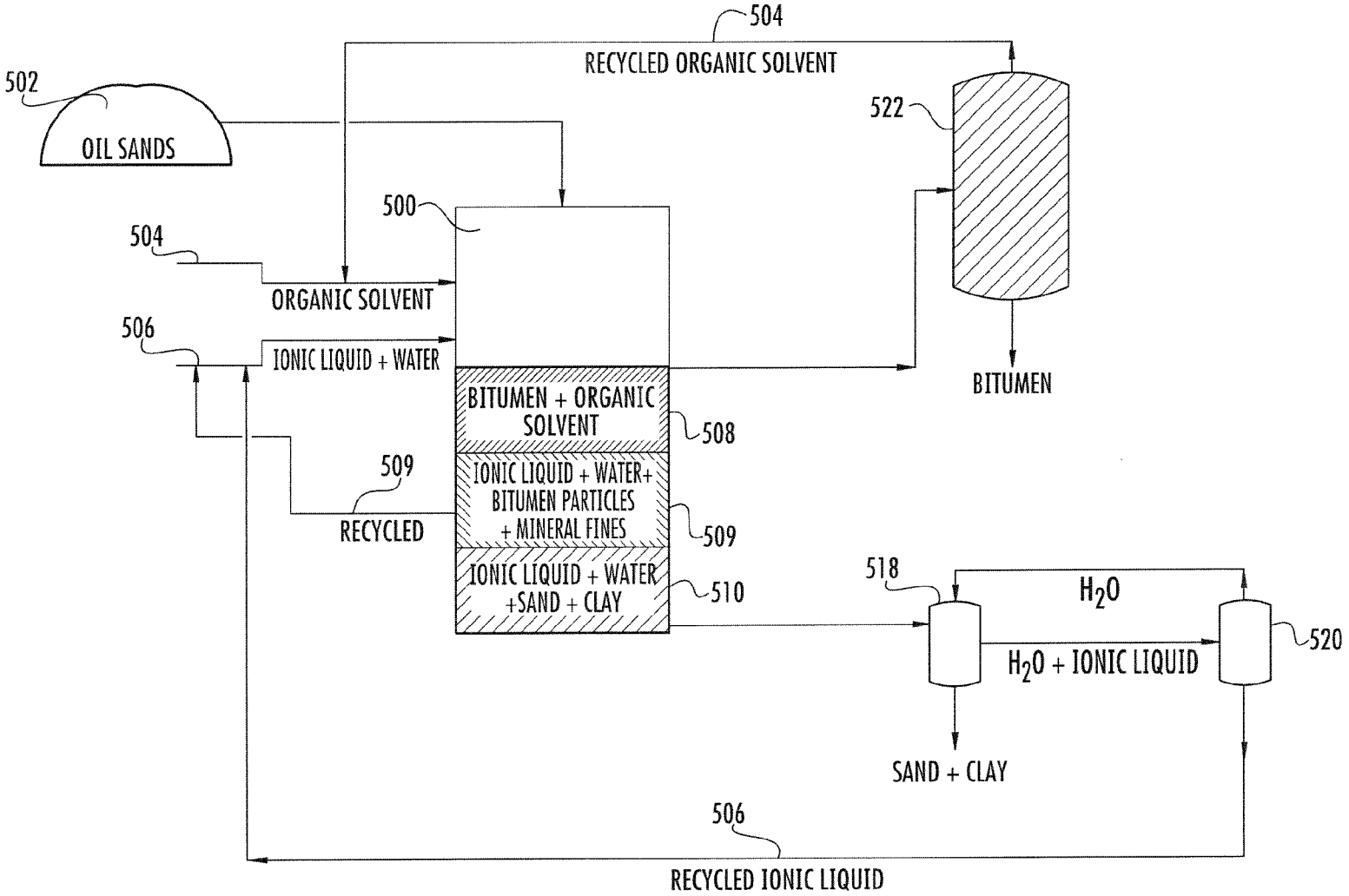
FIG. 5 illustrates an exemplary system for recovering bitumen from oil sands according to another embodiment.

FIG. 5 illustrates an exemplary system for recovering bitumen from oil sands according to another embodiment. Oil sands 502 can include sand, clay, other minerals, and bitumen. The oil sands 502 are mixed with or otherwise placed in contact with an ionic liquid 506, water and optionally an organic solvent 504 in a primary mixing vessel 500 or other separation vessel or column. The primary mixing vessel 500 can be any vessel known in the art for mixing or containing liquids, solids or slurries.

The water may be present within the oil sands in order to economically transport or pump the oil sands to the process facility. Water may also be added to the system to dilute the ionic liquid and reduce cost. When mixed with the organic solvent 504, the ionic liquid 506 and water, the bitumen is separated from the oil sands 502 and a three-phase system including a top phase, middle phase and bottom phase is formed. The bottom phase 510 consists of ionic liquid 506, water and suspended sand and clay. The middle phase 509 consists of ionic liquid 506, water and small amounts of dissolved or suspended bitumen particles and mineral fines. The top phase 508 consists of organic solvent 504 and bitumen. The bottom phase 510, the middle phase 509 and the top phase 508 can be drained from the primary mixing vessel 500 for further processing and/or recycling though the system.

The bitumen in the top phase 508 can be recovered after separating or evaporating the organic solvent 504 from the bitumen in a primary separator 522. The primary separator 522 can be a decanter, distillation column, pressure separator, centrifuge, open tank, hydroclone, settling chamber or other separator known in the art for separating mixtures. The organic solvent 504 can be condensed, recycled to the primary mixing vessel 500 and mixed with additional oil sands 502, organic solvent 504 and ionic liquid 506 to achieve three-phase separation.

The middle phase 509 and substantially all of the ionic liquid 506 introduced into the system can be retained in the mixing vessel 500. In this way, the ionic liquid 506 in the middle phase 509 is not moved throughout the system. If removed for additional processing, the middle phase 509 can be recycled to the primary mixing vessel 500 and mixed with additional oil sands 502, organic solvent 504 and ionic liquid 506 to achieve three-phase separation. The concentration of bitumen within the middle phase 509 is expected to reach equilibrium and therefore will not accumulate. If necessary, organic solvent 504 can be added to the middle phase 509 in an additional processing step to separate any entrained or suspended bitumen from the ionic liquid 506 before the ionic liquid 506 is processed and/or recycled to the primary mixing vessel 500.

The bottom phase 510 consisting of ionic liquid 506, water and suspended sand and clay can be fed into a secondary mixing vessel 518 and mixed with additional water (if necessary) to form a solution of ionic liquid 506, water, and suspended sand and clay particles. The mixing vessel 518 can be any vessel known in the art for mixing or containing liquids, solids or slurries. The sand and clay can be filtered from the ionic liquid and water. The ionic liquid 506 can be recovered after separating or evaporating the water in a secondary separator 520. The separator 520 can be a decanter, distillation column, pressure separator, centrifuge, open tank or other separator known in the art for separating mixtures. After separation and/or evaporation, the water can be condensed before it is recycled to the secondary mixing vessel 518 or primary mixing vessel 500. The ionic liquid 506 can be recycled to the primary mixing vessel 500 and mixed with additional oil sands 502, organic solvent 504 and ionic liquid 506 to achieve three-phase separation.

It will be appreciated that the exemplary system for recovering bitumen from oil sands illustrated in FIG. 5 can also be used to separate other particulate matter including, but not limited to the following: oil sands, drilling fluid containing drill cuttings, crude oil containing sand, beach sand contaminated with oil, oil sludge or any hydrocarbon containing sand, soil, rock, silt, clay or other solid particulate or hydrocarbon contained within sand, soil, rock, silt, clay or other solid particulate. The ionic liquid 506, water and optionally organic solvent 504 can be mixed with or otherwise placed in contact with the particulate matter to separate or dissociate the hydrocarbon from the solid particulate and recover the hydrocarbon as described above.

Figure 6:
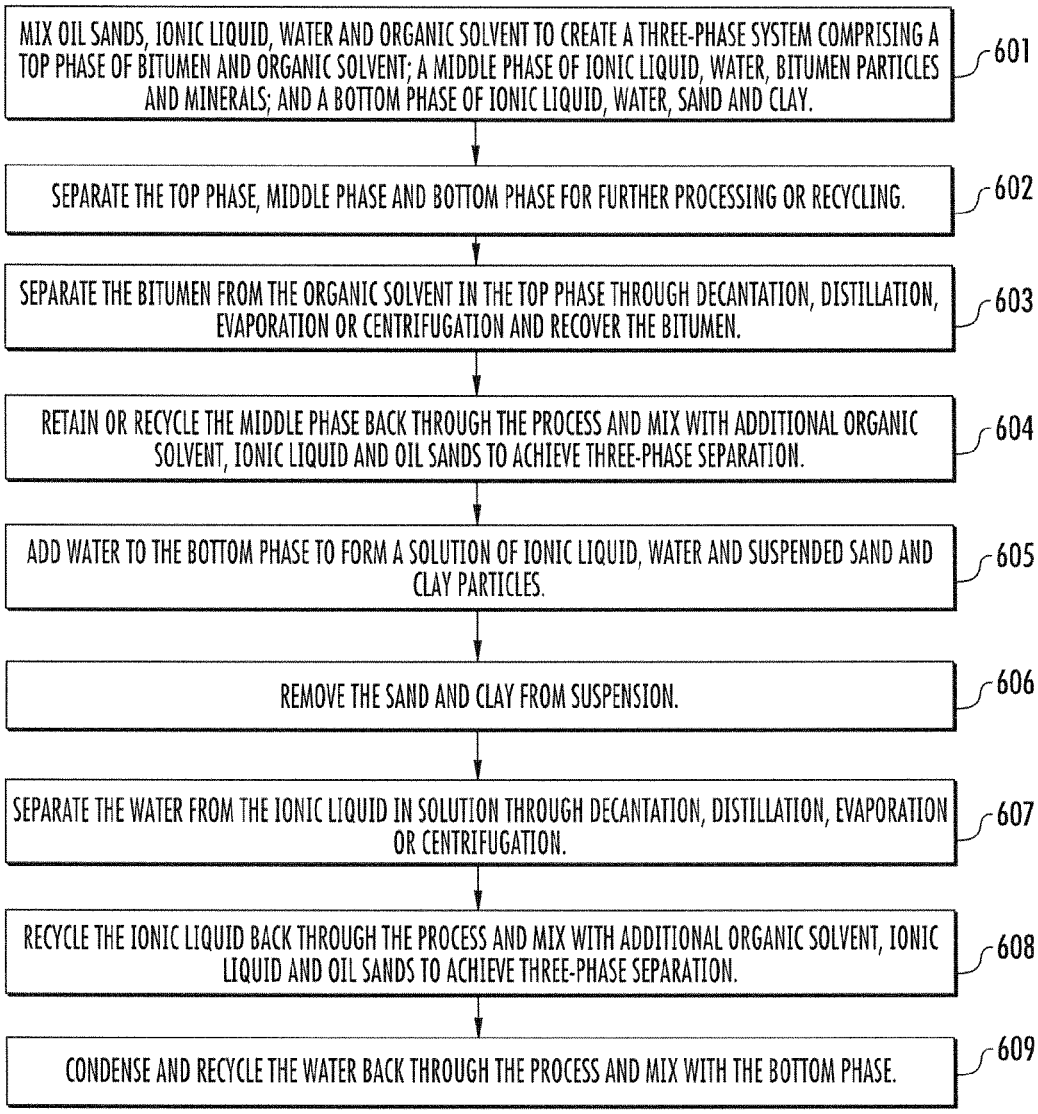
FIG. 6 illustrates a flow chart of an exemplary process for recovering bitumen from oil sands according to another embodiment.

FIG. 6 illustrates a flow chart of an exemplary process for recovering bitumen from oil sands according to one embodiment. The oil sands are mixed with an organic solvent, an ionic liquid and water at step 601 to form a three-phase system including a top phase, middle phase and bottom phase. The top phase consists of organic solvent and bitumen. The middle phase consists of ionic liquid, water and small amounts of dissolved bitumen particles and mineral fines. The bottom phase consists of water, ionic liquid and suspended sand and clay. The top phase, middle phase and bottom phase may be separated at step 602 for further processing or recycling back through the process.

At step 603, the bitumen and the organic solvent in the top phase are separated through decantation, distillation, evaporation or centrifugation and the bitumen is recovered. The organic solvent can be condensed, recycled and mixed with additional oil sands, organic solvent and ionic liquid to achieve three-phase separation.

At step 604, the middle phase is recycled and mixed with additional organic solvent, ionic liquid and oil sands to achieve three-phase separation. Optionally, the middle phase and/or substantially all of the ionic liquid can be retained in a primary mixing vessel within which the original oil sands, organic solvent, ionic liquid and water are mixed.

At step 605, water is added to the bottom phase to form a solution of water, ionic liquid and suspended sand and clay particles. The sand and clay is removed from suspension at step 606 through filtration. At step 607, the water is separated from the ionic liquid through decantation, distillation, evaporation or centrifugation and the ionic liquid is recovered. At step 608 the ionic liquid is recycled and mixed with additional organic solvent, ionic liquid and oil sands to achieve three-phase separation. The water can be condensed, recycled and mixed with the bottom phase at step 609 to separate additional ionic liquid from sand and clay.

It will be appreciated that the exemplary process for recovering bitumen from oil sands illustrated in FIG. 6 can also be used to separate other particulate matter including, but not limited to the following: oil sands, drilling fluid containing drill cuttings, crude oil containing sand, beach sand contaminated with oil, oil sludge or any hydrocarbon containing sand, soil, rock, silt, clay or other solid particulate or hydrocarbon contained within sand, soil, rock, silt, clay or other solid particulate. The ionic liquid, water and optionally organic solvent can be mixed with or otherwise placed in contact with particulate matter to separate or dissociate the hydrocarbon from the solid particulate and recover the hydrocarbon as described above.

EXAMPLES

The following examples are provided to illustrate the exemplary methods for recovering bitumen from oils sands. Medium-grade Canadian oil sands comprising 10 weight percent bitumen was purchased from the Alberta Research Council and used in Examples 1-5 and Comparative Example 1 below. The examples are not intended to limit the scope of the present disclosure and they should not be so interpreted.

Example 1

The ionic liquid 1-butyl-2,3-dimethyl-imidazolium borontetrafluoride was mixed with oil sands at 50° C. A three-phase was formed. The top phase consisted of bitumen. The middle phase consisted of 1-butyl-2,3-dimethyl-imidazolium borontetrafluoride, suspended minerals and bitumen. The bottom phase consisted of a slurry of 1-butyl-2,3-dimethyl-imidazolium borontetrafluoride, sand and clay.

Figure 7:
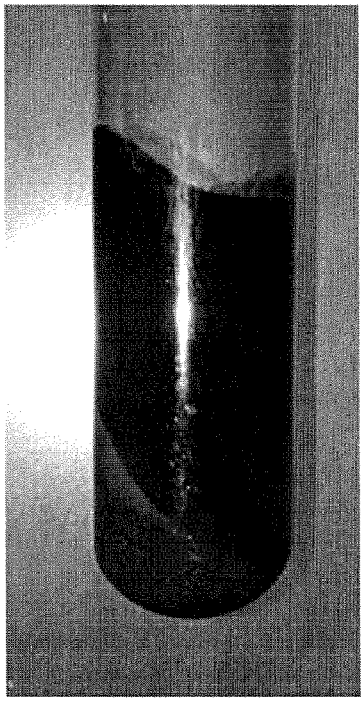
FIG. 7 illustrates an exemplary three-phase system formed from mixing oil sands and ionic liquid according to one embodiment.

FIG. 7 illustrates the three-phase system formed from mixing 1-butyl-2,3-dimethyl-imidazolium borontetrafluoride with oil sands at 50° C. It is a surprising and unexpected result that a highly polar ionic liquid that is immiscible with non-polar hydrocarbons, such as bitumen, toluene and naphtha would be suitable for separating bitumen from sand. It is also unexpected that 1-butyl-2,3-dimethyl-imidazolium borontetrafluoride would separate bitumen from sand at a low temperature of 50° C. or less. It was also observed that a two-phase mixture including a viscous top layer and bottom layer is formed when relatively smaller amounts of ionic liquid are used. The viscous top layer of the two-phase system consisted of bitumen and the bottom layer consisted of ionic liquid, suspended mineral particles and residual bitumen.

Comparative Example 1

Figure 8:
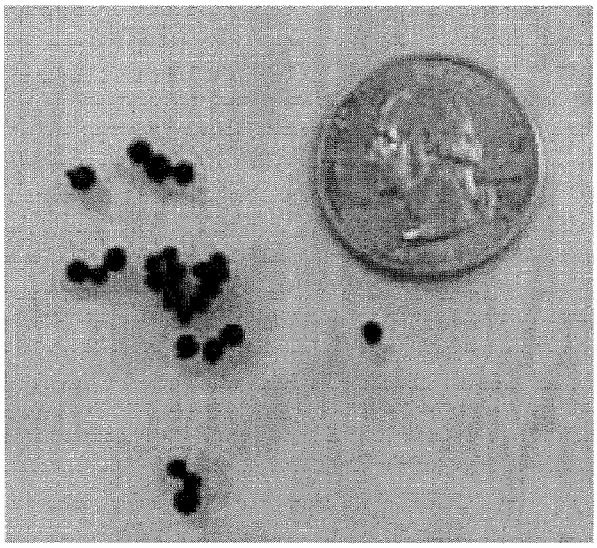
FIG. 8 illustrates a comparative example of bitumen encrusted minerals.

The ionic liquid 1-butyl-3-methyl imidazolium trifluoro-methanesulfonate was mixed with oil sands. The ionic liquid did not separate bitumen from the oil sands, but instead resulted in the formation of agglomerated, spherical, black balls of bitumen-encrusted minerals illustrated in FIG. 8. However, as illustrated in Examples 4and 6, when an organic solvent is added in combination with 1-butyl-3-methyl imidazolium trifluoro-methanesulfonate a clean separation of bitumen from oil sands is unexpectedly achieved.

Example 2

Figure 9:
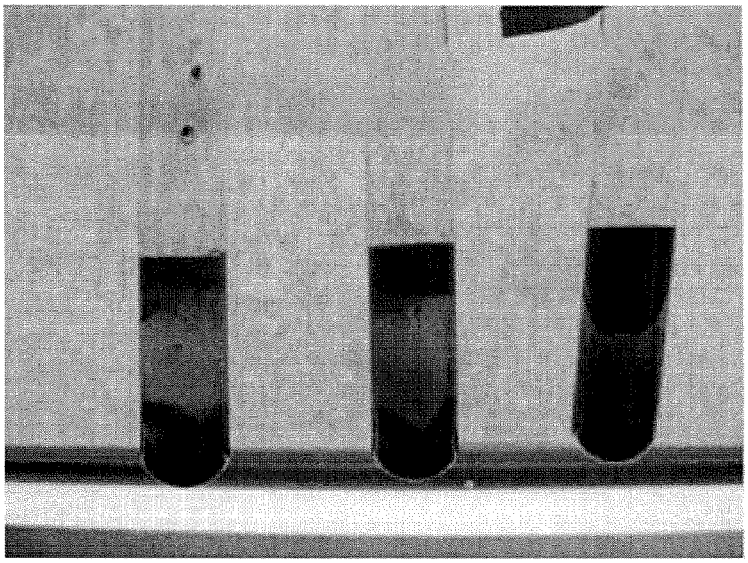
FIG. 9 illustrates exemplary three-phase systems formed from mixing oil sands, ionic liquid and organic solvent according to one embodiment.

A composition of 50 weight percent of the ionic liquid 1-butyl-2,3-dimethyl-imidazolium borontetrafluoride, 33.3 weight percent toluene and 16.7 weight percent oil sands was mixed at temperatures between 50° C. and 60° C. A three-phase system was formed and a clean separation of bitumen from oil sands was unexpectedly achieved. The top phase consisted of toluene and bitumen. The middle phase consisted of 1-butyl-2,3-dimethyl-imidazolium borontetrafluoride with small amounts of dissolved and/or suspended bitumen particles and mineral fines. The bottom phase consisted of 1-butyl-2,3-dimethyl-imidazolium borontetrafluoride with suspended sand and clay. FIG. 9 illustrates the three-phase system (in the right vial) formed from mixing 50 weight percent 1-butyl-2,3-dimethyl-imidazolium borontetrafluoride, 33.3 weight percent toluene and 16.7 weight percent oil sands.

The top phase was removed using a pipette. The toluene was evaporated from the top phase. Upon evaporation of the toluene from the top phase, a residual amount of 1-butyl-2,3-dimethyl-imidazolium borontetrafluoride that was entrained during the separation process remained in the vial below the bitumen phase. Toluene was added to the vial containing the 1-butyl-2,3-dimethyl-imidazolium borontetrafluoride and bitumen and the resulting toluene/bitumen phase was decanted. Due to its high viscosity, the 1-butyl-2,3-dimethyl-imidazolium borontetrafluoride remained at the bottom of the vial while pouring the toluene/bitumen phase into a new vial to achieve a clean separation. The bitumen was recovered after evaporating the toluene. The recovered bitumen comprised about 12-13 weight percent of the original oil sands. The 1-butyl-2,3-dimethyl-imidazolium borontetrafluoride in the middle phase was separated from the sand and clay by adding water to the middle phase and filtering. The water is easily removed from the ionic liquid/water solution by evaporation or any other standard method of liquid-liquid separation.

Example 3

A composition of 50 weight percent of the ionic liquid 1-butyl-2,3-dimethyl-imidazolium trifluoro-methanesulfonate, 33.3 weight percent toluene and 16.7 weight percent oil sands was mixed at temperatures between 50° C. and 60° C. A three-phase system was formed and a clean separation of bitumen from oil sands was unexpectedly achieved. The top phase consisted of toluene and bitumen. The middle phase consisted of 1-butyl-2,3-dimethyl-imidazolium trifluoro-methanesulfonate with small amounts of dissolved and/or suspended bitumen particles and mineral fines. The bottom phase consisted of 1-butyl-2,3-dimethyl-imidazolium trifluoro-methanesulfonate with suspended sand and clay. FIG. 9 illustrates the three-phase system (in the middle vial) formed from mixing 50 weight percent of the ionic liquid 1-butyl-2,3-dimethyl-imidazolium trifluoro-methanesulfonate, 33.3 weight percent toluene and 16.7 weight percent oil sands.

The top phase was removed using a pipette. The toluene was evaporated from the top phase. Upon evaporation of the toluene from the top phase, a residual amount of 1-butyl-2,3-dimethyl-imidazolium trifluoro-methanesulfonate that was entrained during the separation process remained in the vial below the bitumen phase. Toluene was added to the vial containing the 1-butyl-2,3-dimethyl-imidazolium trifluoro-methanesulfonate and bitumen and the resulting toluene/bitumen phase was decanted. Due to its high viscosity, the 1-butyl-2,3-dimethyl-imidazolium trifluoro-methanesulfonate remained at the bottom of the vial while pouring the toluene/bitumen phase into a new vial to achieve a clean separation. The bitumen was recovered after evaporating the toluene. The recovered bitumen comprised about 12-13 weight percent of the original oil sands. The 1-butyl-2,3-dimethyl-imidazolium trifluoro-methanesulfonate in the middle phase was separated from the sand and clay by adding water to the middle phase and filtering. The water is easily removed from the ionic liquid/water solution by evaporation or any other standard method of liquid-liquid separation.

Example 4

A composition of 50 weight percent of the ionic liquid 1-butyl-3-methyl-imidazolium trifluoromethanesulfonate, 33.3 weight percent toluene and 16.7 weight percent oil sands was mixed at temperatures between 50° C. and 60° C. A three-phase system was formed and a clean separation of bitumen from oil sands was unexpectedly achieved. The top phase consisted of toluene and bitumen. The middle phase consisted of 1-butyl-3-methyl-imidazolium trifluoromethanesulfonate with small amounts of dissolved and or suspended bitumen particles and mineral fines. The bottom phase consisted of 1-butyl-3-methyl-imidazolium trifluoromethanesulfonate with suspended sand and clay. FIG. 9 illustrates the three-phase system (in the left vial) formed from mixing 50 weight percent of the ionic liquid 1-butyl-3-methyl-imidazolium trifluoromethanesulfonate, 33.3 weight percent toluene and 16.7 weight percent oil sands.

The top phase was removed using a pipette. The toluene was evaporated from the top phase. Upon evaporation of the toluene from the top phase, a residual amount of 1-butyl-3-methyl-imidazolium trifluoromethanesulfonate that was entrained during the separation process remained in the vial below the bitumen phase. Toluene was added to the vial containing 1-butyl-3-methyl-imidazolium trifluoromethanesulfonate and bitumen and the resulting toluene/bitumen phase was decanted. Due to its high viscosity, the 1-butyl-3-methyl-imidazolium trifluoromethanesulfonate remained at the bottom of the vial while pouring the toluene/bitumen phase into a new vial to achieve a clean separation. The bitumen was recovered after evaporating the toluene. The recovered bitumen comprised about 12-13 weight percent of the original oil sands. The 1-butyl-3-methyl-imidazolium trifluoromethanesulfonate in the middle phase was separated from the sand and clay by adding water to the middle phase and filtering. The water is easily removed from the ionic liquid/water solution by evaporation or any other standard method of liquid-liquid separation.

Figure 10:
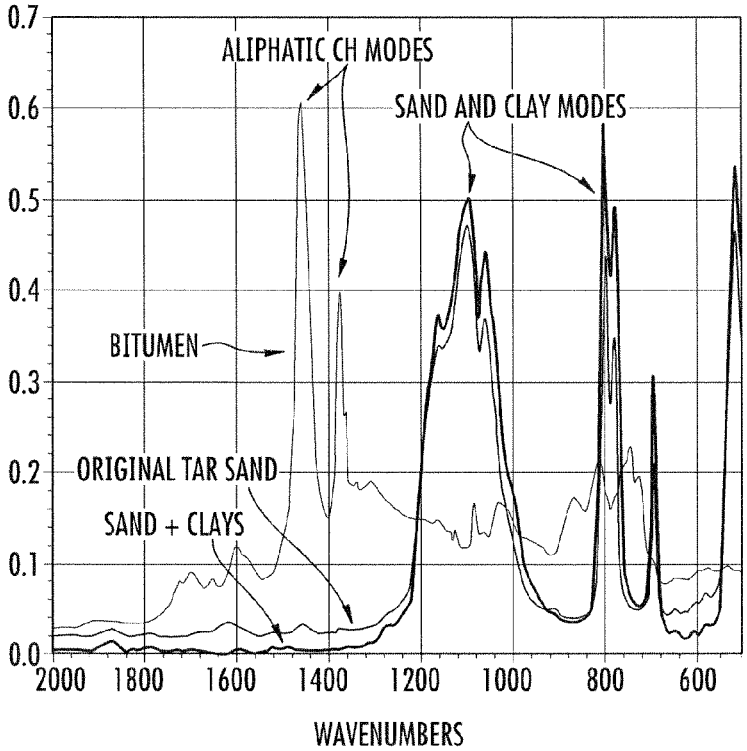
FIG. 10 illustrates an exemplary infrared spectra of medium grade Canadian oil sands and component parts thereof before and after separation of bitumen.

FIG. 10 illustrates infrared spectra of medium-grade Canadian oil sands and component parts thereof before and after separation of bitumen. Upon evaporation of the second addition of toluene in Examples 2-4, the original oil sands sample, the recovered bitumen and the separated sand/clay were analyzed using infrared spectrometry. Bands due to methylene and methyl groups near 1450 $cm^{-1}$ and 1370 $cm^{-1}$ are prominent in the spectrum of the bitumen, and appear with very weak intensity in the spectrum of the oil sands. The mineral bands (predominantly quartz and clay) near 1100 $cm^{-1}$, 800 $cm^{-1}$ and 500 $cm^{-1}$ absorb very strongly in the infrared and mask bands due to organic groups. However, these hydrocarbon absorption modes are essentially undetectable in the spectrum of the sand/clay mixture recovered from the bottom phase, even in scale-expanded spectra. Similarly, the mineral bands are absent from the spectrum of the bitumen. This is most easily seen by examining the right hand end of the plots, near 500 $cm^{-1}$. This demonstrates that the bitumen was separated from the oil sands without carrying over fine particles, unlike the hot or warm water processes presently used in the prior art. In Examples 1-4, a bitumen yield in excess of 90 percent was achieved.

Example 5

A composition of 50 weight percent of the ionic liquid 1-butyl-2,3-dimethyl-imidazolium borontetrafluoride, 33.3 weight percent toluene and 16.7 weight percent oil sands was mixed at a temperatures of 25° C. A three-phase system was formed and a clean separation of bitumen from oil sands was unexpectedly achieved. The top phase consisted of toluene and bitumen. The middle phase consisted of 1-butyl-2,3-dimethyl-imidazolium borontetrafluoride with small amounts of dissolved and/or suspended bitumen particles and mineral fines. The bottom phase consisted of 1-butyl-2,3-dimethyl-imidazolium borontetrafluoride with suspended sand and clay.

The top phase was removed using a pipette. The toluene was evaporated from the top phase. Upon evaporation of the toluene from the top phase, a residual amount of 1-butyl-2,3-dimethyl-imidazolium borontetrafluoride that was entrained during the separation process remained in the vial below the bitumen phase. Toluene was added to the vial containing the 1-butyl-2,3-dimethyl-imidazolium borontetrafluoride and bitumen and the resulting toluene/bitumen phase was decanted. Due to its high viscosity, the 1-butyl-2,3-dimethyl-imidazolium borontetrafluoride remained at the bottom of the vial while pouring the toluene/bitumen phase into a new vial to achieve a clean separation. The bitumen was recovered after evaporating the toluene. The recovered bitumen comprised about 12-13 weight percent of the original oil sands. The 1-butyl-2,3-dimethyl-imidazolium borontetrafluoride in the middle phase was separated from the sand and clay by adding water to the middle phase and filtering. The water is easily removed from the ionic liquid/water solution by evaporation or any other standard method of liquid-liquid separation.

Examples 1-5 involve the separation of bitumen from medium-grade oil sands. No detectable mineral fines were recovered with the bitumen in Examples 1-5. Bitumen in low-grade oil sand feedstock is more difficult to recover free of mineral fine. The prior art warm water separation processes leave a significant amount of mineral fines in the separated and recovered bitumen, which leads to subsequent processing problems and reduces the economic viability of the process. The separation and recovering of bitumen with the use of the exemplary systems, methods and ionic liquids herein disclosed left no detectable mineral fines at separation temperatures below 100° C., preferably below 50° C. and more preferably at temperatures of 25° C. and lower.

Example 6

Examples 1-5 were also conducted at mixing ratios of 25 weight percent ionic liquid, 50 weight percent organic solvent and 25 weight percent low-grade oil sands at a temperature of 25° C. and lower. A three-phase separation of low grade oil sands and yields of bitumen in excess of 90 percent were unexpectedly achieved.

Figure 11:
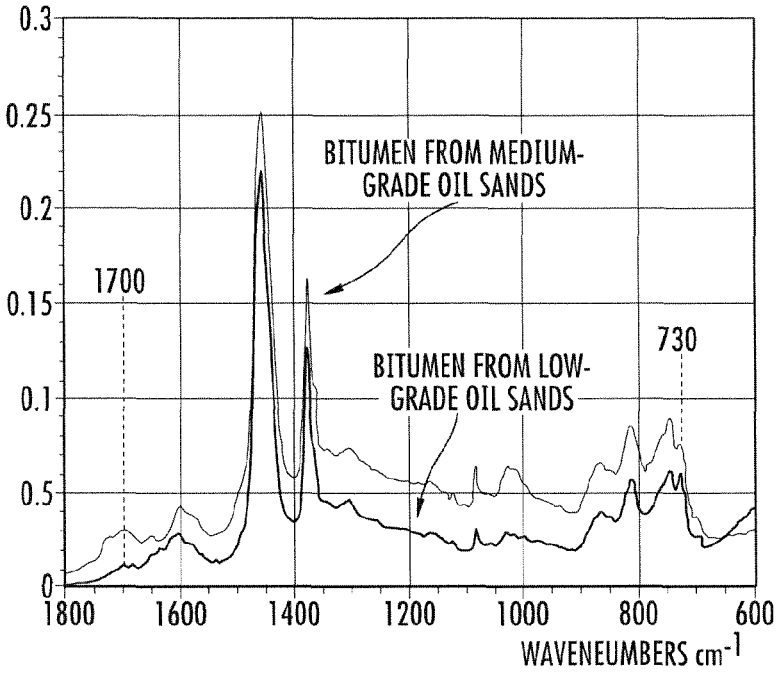
FIG. 11 illustrates an exemplary infrared spectra of low-grade oil sands and medium-grade oil sands after separation of bitumen.

FIG. 11 illustrates the infrared spectra of low-grade oil sands and medium-grade oil sands after separation of bitumen at 25° C. using the mixing ratio of Example 6. Strong infrared absorption bands due to minerals near 1000 $cm^{-1}$ cannot be detected in the low-grade oil sands spectra or the medium-grade oil sands spectra. It was surprisingly found that low-grade oil sands can be separated to produce bitumen free of mineral fines at low temperatures (e.g., 25° C. and lower) using the systems, methods and ionic liquids herein disclosed.

In Examples 1-6, a separation of bitumen from both medium-grade and low-grade oil sands was achieved without the use of water in the primary separation step. Some water was used in Examples 1-6 to remove ionic liquid from sand, but as disclosed herein, the water can be separated and recycled through the system with substantially no loss. In some circumstances, the particulate matter including hydrocarbons and solid particulate is mixed with significant quantities of water to transport or pump the particulate matter. For example, in some oil sands mining operations, water is used to transport the mixture as slurry to a processing plant. With the use of the systems, methods and compositions herein disclosed the water does not have to be removed prior to separation of hydrocarbon from the solid particulate.

Examples 7-8 are provided to illustrate exemplary methods for recovering bitumen from low-grade and medium-grade Canadian oils sands with the use of water in the primary separation step. The examples are not intended to limit the scope of the present disclosure and they should not be so interpreted.

Example 7

A separating composition of 50 weight percent of the ionic liquid 1-butyl-2,3-dimethyl-imidazolium borontetrafluoride and 50 weight percent water was created. 2 grams of the separating composition and 3 grams of toluene were mixed respectively with 1 gram of low-grade oil sands and 1 gram of medium-grade oil sands in two separate experiments at a temperature of 25° C. The separating composition created a three phase system when mixed with low-grade oil sands and medium-grade oil sands.

Figure 12:
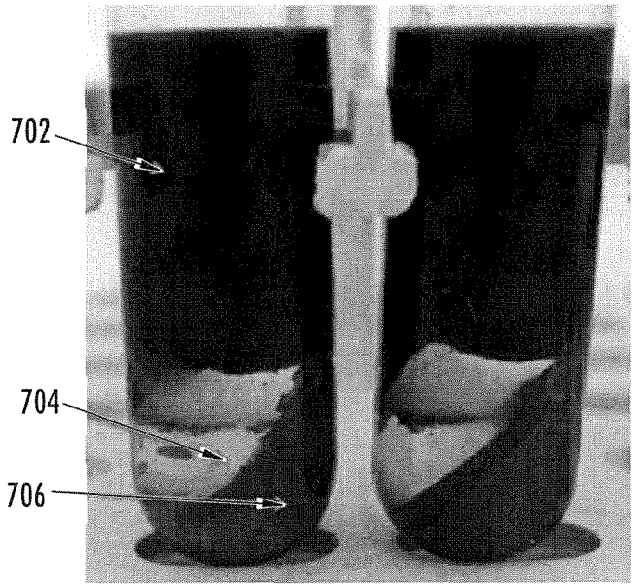
FIG. 12 illustrates exemplary three-phase systems formed from mixing an exemplary separating composition and toluene with low-grade and medium-grade oil sands according to one embodiment.

FIG. 12 illustrates exemplary three-phase systems formed from mixing the separating composition of Example 7 and toluene with low-grade and medium-grade oil sands. The vial on the left of in FIG. 12 illustrates a three phase system formed from separating low-grade oil sands and the vial on the right illustrates a three phase system formed from separating medium-grade oil sands. The bottom phase 706 of the vials contains a slurry of ionic liquid, water and sand. The middle phase 704 of the vials contains ionic liquid, water and small amounts of mineral fines. The top phase 702 of the vials contains a dark organic layer of bitumen dissolved in toluene. The top phase of the vials was separated using a pipette. Toluene was then evaporated from the bitumen in the top phase in a vacuum oven. A yield of 3.6 percent bitumen was achieved in low-grade oil sand using the separating composition of Example 7. A yield of 14.6 percent bitumen was achieved in medium-grade oil sand using the separating composition of Example 7.

Example 8

A separating composition of 25 weight percent of the ionic liquid 1-butyl-2,3-dimethyl-imidazolium borontetrafluoride and 75 weight percent water was created. 2 grams of the separating composition was mixed with 3 grams of toluene and 1 gram of low-grade oil sands at a temperature of 25° C. The separating composition created a three phase system when mixed with low-grade oil sands. The bottom phase contained a slurry of ionic liquid, water and sand. The middle phase contained ionic liquid, water and small amounts of mineral fines. The top phase contained a dark organic layer of bitumen dissolved in toluene. The top phase was separated using a pipette. Toluene was then evaporated from the bitumen in the top phase in a vacuum oven. A yield of 5.1 percent bitumen was achieved in low-grade oil sand using the separating composition of Example 8.

Figure 13:
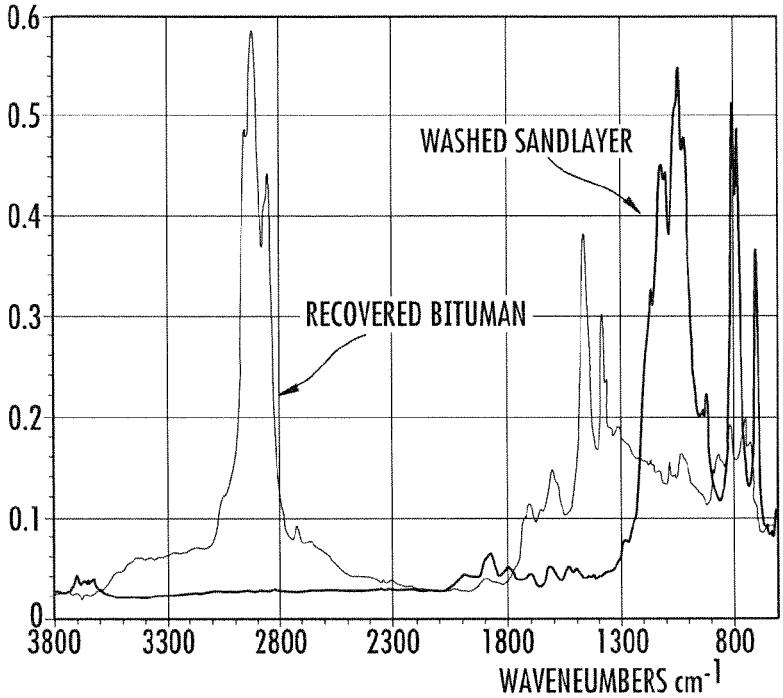
FIG. 13 illustrates the infrared spectra of extracted bitumen and residual sand obtained in the separation of low-grade oil sands using an exemplary separating composition according to one embodiment.

FIG. 13 illustrates the infrared spectra of extracted bitumen and residual sand obtained in the separation of low-grade oil sands using the separating composition of Example 8. It was surprisingly found that bitumen bands between 2800 $cm^{-1}$ and 3000 $cm^{-1}$ are absent in the spectrum of the residual materials and mineral bands between 1000 $cm^{-1}$ and 800 $cm^{-1}$ are absent in the spectrum of bitumen. Therefore, a clean separation of low-grade oil sands with no residual sand in separated bitumen and no residual bitumen in separated sand was achieved.

The Canadian oil sands that were separated in Examples 1-8 were unconsolidated samples of oil sands. Utah oil sands are consolidated rock-like formations that cannot be processed directly with the prior art warm water processes presently used for unconsolidated oil sands. Example 9 is provided to illustrate the effectiveness the systems, methods and compositions herein disclosed in separating consolidated Utah oil sands. The example is not intended to limit the scope of the present disclosure and should not be so interpreted.

Example 9

A composition of 33.3 weight percent of the ionic liquid 1-butyl-2,3-dimethyl-imidazolium borontetrafluoride, 50.0 weight percent toluene and 16.7 weight percent consolidated Utah oil sands was mixed at a temperatures of 25° C. A three-phase system was formed and a clean separation of bitumen from oil sands was unexpectedly achieved. The top phase consisted of toluene and bitumen. The middle phase consisted of 1-butyl-2,3-dimethyl-imidazolium borontetrafluoride with small amounts of dissolved and/or suspended bitumen particles and mineral fines. The bottom phase consisted of 1-butyl-2,3-dimethyl-imidazolium borontetrafluoride with suspended sand and clay. The top phase was removed using a pipette. The toluene was evaporated from the top phase. The bitumen was recovered after evaporating the toluene. A yield of over 90 percent bitumen from the original sample of oil sands was obtained with no detectable mineral fines in the bitumen.

Example 10

In this example, the ionic liquid 1-butyl-2,3-dimethyl-imidazolium borontetrafluoride, and toluene were used to separate oil from sand in a contaminated sand sample. The ionic liquid 1-butyl-2,3-dimethyl-imidazolium borontetrafluoride, the toluene and the contaminated sand sample were mixed in the proportions 1:2:3 by weight at 25° C. to achieve three phase separation. Other proportions can also be used to achieve three phase separation.

Figure 14:
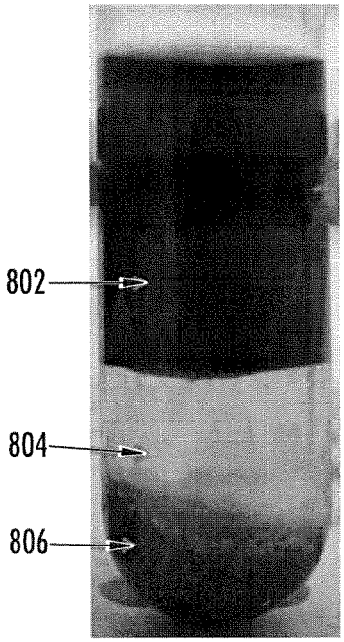
FIG. 14 illustrates an exemplary three-phase system formed from mixing ionic liquid, organic solvent and contaminated sand according to one embodiment.

FIG. 14 illustrates an exemplary three-phase system formed from mixing ionic liquid (e.g., 1-butyl-2,3-dimethyl-imidazolium borontetrafluoride), organic solvent (e.g., toluene) and contaminated sand according to Example 10. The top phase 802 contained oil and toluene. The middle phase 804 contained ionic liquid, residual mounts of oil and mineral fines. The bottom phase 806 contained ionic liquid and sand.

The three phases are easily separated in the laboratory using a pipette as described in the previous examples. Any inadvertent entraining of one phase in another can be alleviated by washing the phase with water or a non-polar solvent (e.g., toluene) depending on the phase which requires purification. The toluene is readily removed from the top phase though distillation. It is important to note, that the top phase containing oil and toluene contained no detectable mineral fines. The ionic liquid in the bottom phase was removed by washing with water. The sand in the bottom phase contained no detectable toluene or oil contamination after the ionic liquid was removed.

Example 11

In this example, ionic liquid 1-butyl-2,3-dimethyl-imidazolium borontetrafluoride, and toluene were used to separate oil from drill cuttings in a contaminated drill cuttings sample. The ionic liquid 1-butyl-2,3-dimethyl-imidazolium borontetrafluoride, the toluene and the contaminated drill cuttings were mixed at 25° C. to achieve three phase separation. The top phase contained oil and toluene. The middle phase contained ionic liquid, residual mounts of oil, residual mineral fines and residual drill cuttings. The bottom phase contained ionic liquid and drill cuttings.

The three phases are easily separated in the laboratory using a pipette as described in the previous examples. Any inadvertent entraining of one phase in another can be alleviated by washing the phase with water or a non-polar solvent (e.g., toluene) depending on the phase. The toluene in the top phase is removed through distillation. The ionic liquid in the bottom phase was removed by washing with water.

Figure 15:
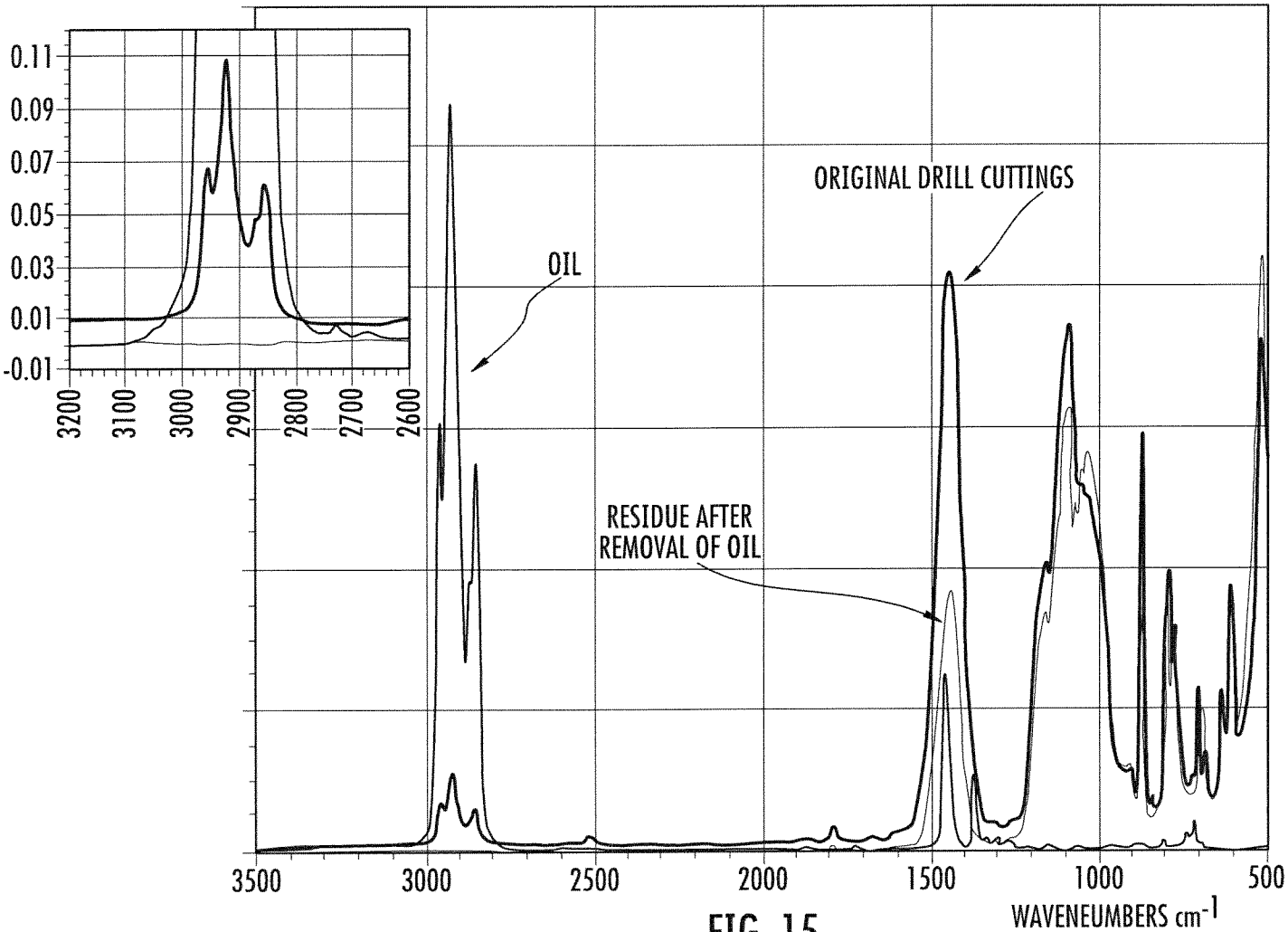
FIG. 15 illustrates the infrared spectra of contaminated drill cuttings and component parts thereof before and after separation of oil.

FIG. 15 illustrates infrared spectra of the original contaminated drill cuttings, oil after separation and material after removal of oil. The spectrum of the original drill cuttings is dominated by silicate (sand) absorption between 1000 and 1100 $cm^{-1}$. There is also a strong absorption due to carbonates near 1450 $cm^{-1}$, similar to what is observed in the spectrum of chalk. Minerals absorb infrared radiation far more strongly than oil, but only weakly absorbing modes between 2800 and 3000 $cm^{-1}$ are observed. An absorption scale-expanded insert, which reveals the bands due to the oil in the spectrum of the drill cuttings, is also illustrated in FIG. 15. However, these absorptions are absent from the spectrum of the residual materials after removal of oil. Therefore, the residual materials including drill cuttings are free from oil contamination. It can also be seen from the spectrum of oil, that the oil was recovered free of minerals and drill cuttings.

Example embodiments have been described hereinabove regarding improved systems, methods and compositions for the separation and recovery of hydrocarbons from particulate matter. The systems, methods and compositions herein disclosed require significantly less water and less energy to recover hydrocarbons in processes such as the recovery of bitumen from oil sands. Various modifications to and departures from the disclosed example embodiments will occur to those having ordinary skill in the art. The subject matter that is intended to be within the spirit of this disclosure is set forth in the following claims.

What is claimed is:

1. A method of separating a hydrocarbon from solid particulate, the method comprising:

contacting a particulate matter comprising at least one hydrocarbon and at least one solid particulate with a separating liquid to separate the at least one hydrocarbon from the solid particulate;

wherein the separating liquid comprises at least 25 percent by weight of at least one ionic liquid selected from the group consisting of an imidazolium salt, tetraalkyl ammonium salt, pyrrolidinium based salt, and combinations thereof; and wherein the separating liquid separates at least 90% of the at least one hydrocarbon from the solid particulate.

2. The method as recited in claim 1, further comprising recovering the at least one hydrocarbon.

3. The method as recited in claim 2, further comprising recovering the at least one solid particulate.

4. The method as recited in claim 1, wherein the separating liquid further comprises at least one organic solvent.

5. The method as recited in claim 1, wherein the separating liquid further comprises water.

6. The method as recited in claim 1, wherein contacting the particulate matter comprises contacting the particulate matter at a temperature of less than or equal to 100° C.

7. The method as recited in claim 1, wherein contacting the particulate matter comprises contacting the particulate matter at a temperature of less than or equal to 50° C.

8. The method as recited in claim 1, further comprising permitting the at least one hydrocarbon, solid particulate and separating liquid to form a multiphase system and separating the hydrocarbon from the multiphase system by any one or more steps of: decanting at least a portion of the multiphase system, evaporating at least a portion of the multiphase system, distilling at least a portion of the multiphase system, centrifuging at least a portion of the multiphase system or filtrating at least a portion of the multiphase system.

9. The method as recited in claim 1, wherein the at least one hydrocarbon comprises at least one hydrocarbon selected from the group consisting of: bitumen, oil and drilling fluid.

10. The method as recited in claim 1, wherein the at least one solid particulate comprises at least one solid particulate selected from the group consisting of: sand, soil, silt, clay, rock, minerals and drill cuttings.

11. The method as recited in claim 1, wherein the at least one ionic liquid is an imidazolium salt.

12. The method as recited in claim 1, wherein the multiphase system comprises three phases.

13. The method as recited in claim 4, wherein the at least one organic solvent is at least one organic solvent selected from the group consisting of: toluene, naphtha, hexane, kerosene and paraffinic solvents.

14. The method as recited in claim 11, wherein the imidazolium salt is selected from the group consisting of: 1-butyl-2,3-dimethylimidazolium borontetrafluoride; 1-butyl-2,3-dimethyl- imidazolium trifluoro-methanesulfonate; 1-butyl-3-methyl-imidazolium trifluoromethanesulfonate; 1-butyl-3-methyl-imidazolium chloride; 1-ethyl-3-methyl-imidazolium chloride.

15. The method as recited in claim 1, wherein the particulate matter includes oil sands and the at least one hydrocarbon includes bitumen.

16. The method as recited in claim 1, wherein the contacting step includes mixing oil sands composed of bitumen and sand as the particulate matter with the separating liquid which further includes an organic solvent; and further comprising allowing the mixture to form a three phase system comprising a top phase including the bitumen, a middle phase including the ionic liquid and a bottom phase including the sand; and separating the top phase from the other phases to recover the bitumen.

* * * * *